US005137229A

United States Patent [19]

Kraus

[11] Patent Number: 5,137,229

[45] Date of Patent: Aug. 11, 1992

[54] WING EXTENDABLE FROM AN AIRBORNE BODY

[75] Inventor: Manfred Kraus, Eckental, Fed. Rep. of Germany

[73] Assignee: Diehl GmbH & Co., Nuremberg, Fed. Rep. of Germany

[21] Appl. No.: 705,338

[22] Filed: May 24, 1991

[30] Foreign Application Priority Data

May 25, 1990 [DE] Fed. Rep. of Germany ..... 4016840

[51] Int. Cl.[5] ..... B64C 3/56

[52] U.S. Cl. ..... 244/49; 244/218; 244/3.27; 244/3.28; 244/3.29

[58] Field of Search ..... 244/49, 46, 218, 3.27, 244/3.28, 3.29, 3.26, 3.24

[56] References Cited

U.S. PATENT DOCUMENTS

| | | | |
|---|---|---|---|
| 3,347,491 | 10/1957 | Jean-Baptiste et al. | 244/3.27 |
| 3,819,132 | 6/1974 | Rusbach | 244/3.28 |
| 4,090,684 | 5/1978 | Look et al. | 244/218 |
| 4,262,862 | 4/1981 | Hütter | 244/3.29 |
| 4,336,914 | 1/1982 | Thomson | 244/46 |
| 4,364,531 | 12/1982 | Knoski | 244/3.27 |
| 4,411,398 | 10/1983 | Wedertz et al. | 244/3.28 |
| 4,586,681 | 5/1986 | Wedertz et al. | 244/49 |
| 4,635,881 | 1/1987 | Brieseck et al. | 244/49 |
| 4,664,338 | 5/1987 | Steuer et al. | 244/49 |
| 4,664,339 | 5/1987 | Crossfield | 244/3.28 |
| 4,923,143 | 5/1990 | Steuer et al. | 244/3.28 |
| 5,039,030 | 8/1991 | Kraus | 244/49 |

FOREIGN PATENT DOCUMENTS

| | | |
|---|---|---|
| 3918244 | 12/1990 | Fed. Rep. of Germany . |
| 41371 | 1/1933 | France . |
| 715385 | 1/1933 | France . |
| 2280875 | 2/1976 | France . |

OTHER PUBLICATIONS

European Search Report.

*Primary Examiner*—Joseph F. Peters, Jr.
*Assistant Examiner*—Christopher P. Ellis
*Attorney, Agent, or Firm*—Scully, Scott, Murphy & Presser

[57] ABSTRACT

A wing which is extendable from an airborne body. The wing includes a base spar which is actuatable through the operation of a power element, a nose spar which has one of the end sections thereof supported for pivotal movement about a bearing axis located on the airborne body and at least one lamella or sheet metal element which extends at least approximately in parallel with the nose spar in every angular position thereof, which has one end section thereof pivotably supported on the base spar by means of a lamella axis. A stabilizing element is supported for pivoting about a connecting axis at the second end section of the nose spar which is distant from the first end section, and extends through contact or positioning elements at the second end section of the at least one lamella element distant from the associated lamella axis.

2 Claims, 2 Drawing Sheets

WING EXTENDABLE FROM AN AIRBORNE BODY

BACKGROUND OF THE INVENTION

1. Field of the Invention

The present invention relates to a wing which is extendable from an airborne body.

The wing includes a base spar which is actuatable through the operation of a power element, a nose spar which has one of the end sections thereof supported for pivotal movement about a bearing axis located on the airborne body and at least one lamella or sheet metal element which extends at least approximately in parallel with the nose spar in every angular position thereof, which has one end section thereof pivotably supported on the base spar by means of a lamella axis. A stabilizing element is supported for pivoting about a connecting axis at the second end section of the nose spar which is distant from the first end section, and extends through contact or positioning elements at the second end section of the at least one lamella element distant from the associated lamella axis.

2. Discussion of the Prior Art

The wing also incorporates a latching device for restraining the base spar in the retracted basic position of the lamella wing and for the release of the base spar and the at least one lamella element upon an activation of the power element; for example, such as disclosed in U.S. Pat. No. 5,039,030; issued on Aug. 13, 1991; commonly assigned to the present assignee and the disclosure of which is incorporated by reference herein. In that instance, there is described a latching device which is arranged in proximity to the bearing axis for the nose spar and is equipped with a shear pin as well as with a spring-biased slideable displaceable bolt with a conically-shaped contact segment. With the aid of this latching device located in proximity to the bearing axis of the nose spar, it is possible to maintain the base spar, until its activation by means of the power element which is operatively connected with the base spar, in the basic position thereof, and subsequent to the extension of the lamella wing to securely retain the latter in the end position thereof in its extended condition.

SUMMARY OF THE INVENTION

Accordingly, it is an object of the present invention to provide a wing of lamella construction pursuant to the above-mentioned type wherein the nose spar and the at least one lamella element which extends at least approximately in parallel with the nose spar in each angular position thereof is, in its retracted basic position, securely restrained therein until an activation of the power element.

This object is inventively attained in that, in addition to the latching device as described in U.S. Pat. No. 5,039,030, which is commonly assigned to the present assignee, the latching device possesses at least one hook element operable between the restraining position and the releasing position about an axis which is fixedly located on the airborne body, whereby the at least one hook element is hooked into the connecting axis between the nose spar and the stabilizing element in the retracted basic or initial position of the lamella wing, and wherein the lamella element, or the lamella which adjoins the nose spar contacts or lies against the latching device with the contacting or positioning section provided on its second end section. Due to the presence of this hook element, which is provided at the trailing end portion of the retracted lamella wing, there is obtained a securing of the lamella wing against any undesired extension of the nose spar and the at least one lamella element, and as a result of the lamella wing away from the airborne body. By means of the inventively constructed latching device with the provision of the at least one hook element there is obtained a securing of the lamella wing in its retracted basic position as long as the power element which is operatively connected with the base spar of the lamella wing is not activated.

It has been ascertained as being expedient when the latching device possesses two mutually spaced and with respect to each other at least approximately parallel-oriented hook elements and an extension part, whereby a deformable connecting segment is provided intermediate the extension part and the hook elements, and in which the lamella element or that lamella element which, in essence, adjoins the nose spar, in the retracted basic position of the lamella wing has its contacting section contact against the extension part of the latching device.

The axis or pivoting axle which is fixedly located on the airborne body, and about which the at least one hook element of the latching device is pivotably supported; in essence, forms the turning point for the at least one hook element, about which the at least one hook element, and preferably the two mutually spaced and relative to each other at least approximately in parallel-oriented hook elements, will carry out their opening movement upon an activation of the power element which is operatively connected with the base spar. As a result of this pivoting opening movement, the at least one hook element is released from the connecting axis which is present between the nose spar and the stabilizing element, so that the lamella wing can be displaced from its retracted basic or initial position into the flying position in which it is extended away from the airborne body. This movement in the extending of the lamella wing is initiated through the sliding movement of the base spar from its initial position into a subsequent second position, whereby this sliding movement can be in the magnitude of about 2 mm. Hereby, inasmuch as the lamella element, or that element which respectively adjoins the nose spar, in the retracted basic position of the lamella wing contacts has its contacting section lying against the extension part of the latching device, the sliding movement of the base spar is accordingly transmitted by means of the at least one lamella element to the latching device or, in effect, to its extension part. This sliding movement of the base spar or, in essence, the at least one lamella element, as has been mentioned, consists of only a few millimeters, produces a deformation of the connecting segment between the at least one hook element and the extension part of the latching device and, as a result thereof, causes a pivoting movement of the at least one hook element about its axle which is fixedly located in the airborne body, as a result of which the at least one hook element releases the connecting axis through which the nose spar is pivotably connected with the stabilizing element. After the release of the connecting axis between the nose spar and the stabilizing element it is possible to extend the lamella wing through a correspondingly effected sliding displacement of the base spar along the longitudinal direction of the airborne body in an energy-saving manner within the shortest period of time into the flying position in which the wing is extended from the airborne body.

A latching device with at least one hook element and an extension part, which is connected with the at least one hook element through the intermediary of the deformable connecting segment, and as a result is unitarily constructed, possesses the advantage that such a latching device can be simply manufactured and is especially simple to handle; in effect, arrangeable on a suitable airborne body.

BRIEF DESCRIPTION OF THE DRAWINGS

Further details, features and advantages of the invention can now be more readily ascertained from the following detailed description of the inventive lamella wing which is illustrated generally diagrammatically in the drawings; and in which.

DETAILED DESCRIPTION

Figure 1:
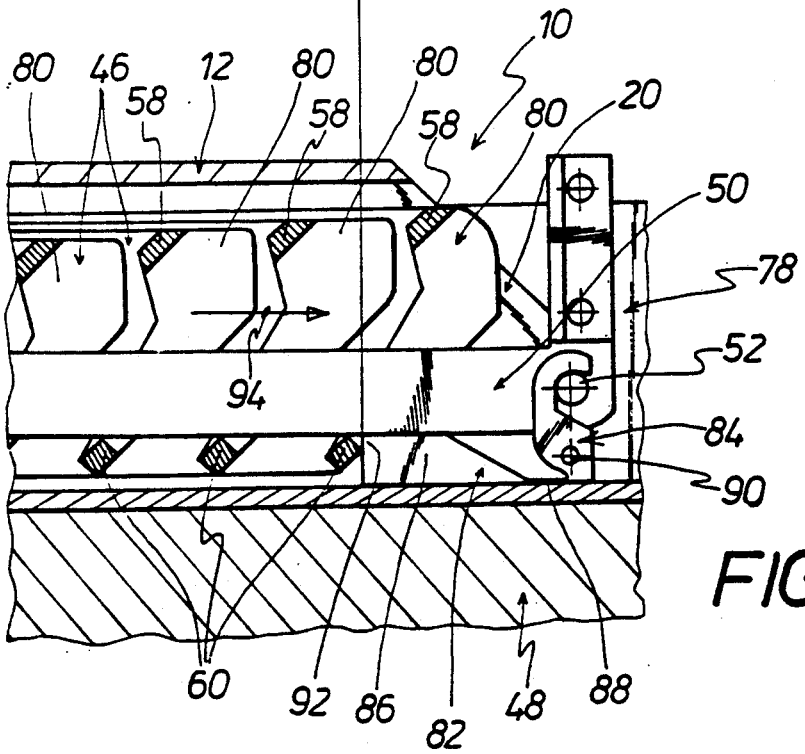
FIG. 1 illustrates the rearward end section of the inventive lamella wing shown in the retracted initial position, wherein the airborne body is indicated in fragmentary detail.

Referring now in specific detail to the drawings, FIG. 1 illustrates a fragmentary segment of the airborne body 48, with a segment of the lamella wing 10 shown in its retracted initial or basic position in which it is retracted into the airborne body 48 or; in essence, into a recess 78 which is formed in the airborne body 48. The lamella wing 10 possesses a nose spar 12 and a plurality of lamella or sheet metal elements 46. The lamella elements 46 are each provided at their respective second end section 80 with contact or positioning elements 58 and 60, through which there extends a stabilizing element 50. The stabilizing element 50 is arranged so as to be pivotable by means of a connecting axle 52 located at the second end section 20 of the nose spar 12.

For the secure retention of the lamella wing 10 in the basic initial position which is shown in fragmentary section in FIG. 1, there serves a latching device 82 which possesses two hook elements 84, an extension part 86 and a deformable connecting segment 88. Of the two hook elements 84, both of which possess the same external contour and which are arranged at least approximately in parallel with each other, in FIG. 1 there is only visible one hook element since the second hook element is exactly covered by the first hook element. The two hook elements 84 are pivotable about an axis which is fixedly constructed on the airborne body 48 between the restraining or latching position illustrated in FIG. 1 and the releasing position illustrated in FIGS. 2 and 3.

Figure 2:
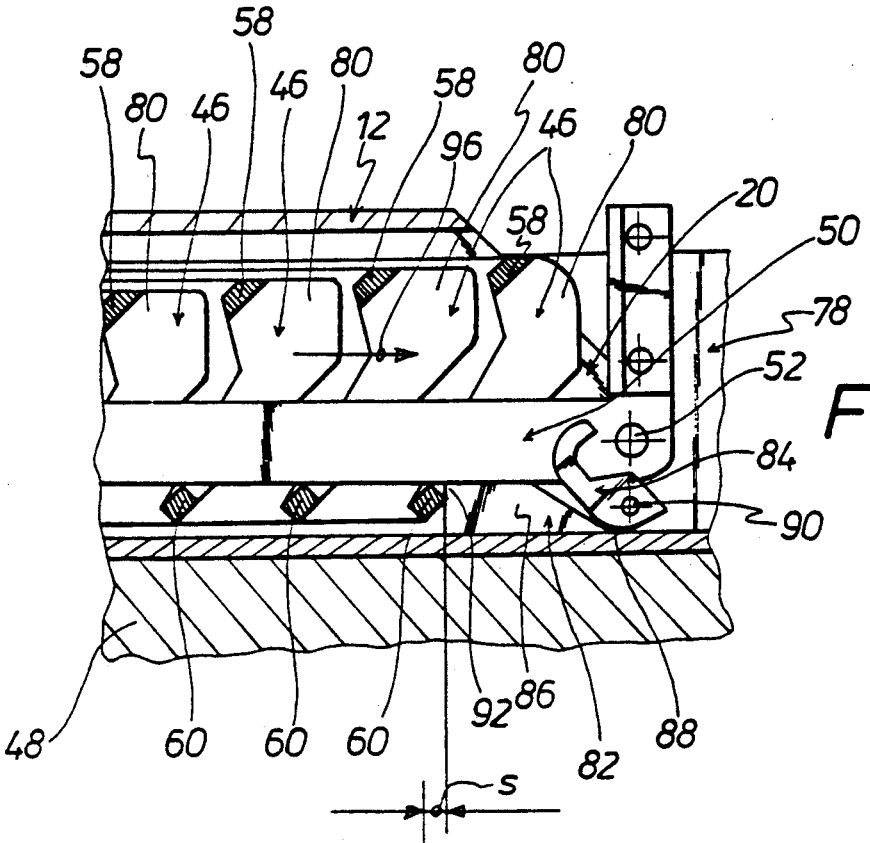
FIG. 2 illustrates a representation which is similar to that of FIG. 1, wherein in FIG. 2 there is shown the second operative position in which the lamella element, or that adjacent to the nose spar, in comparison with the initial position illustrated in FIG. 1, has carried out a sliding movement of a few millimeters to cause the at least one hook element of the latching device to release the connecting axis between the nose spar and the stabilizing element.
Figure 3:
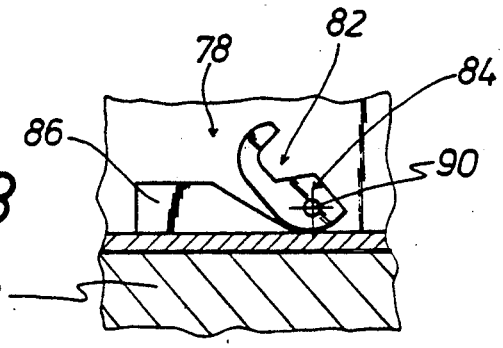
FIG. 3 illustrates the latching device in the releasing position.

In the restraining position thereof, the two hook elements 84 are hooked onto the connecting axis 52 of the nose spar 12 or, respectively, the stabilizing element 50, whereas the hook elements 84 in the releasing position as illustrated in FIGS. 2 and 3, are pivoted about the stationary axis 90 in such a manner that the connecting axis 52, by means of which the nose spar 12 is pivotably connected with the stabilizing element, will be released.

Figure 4:
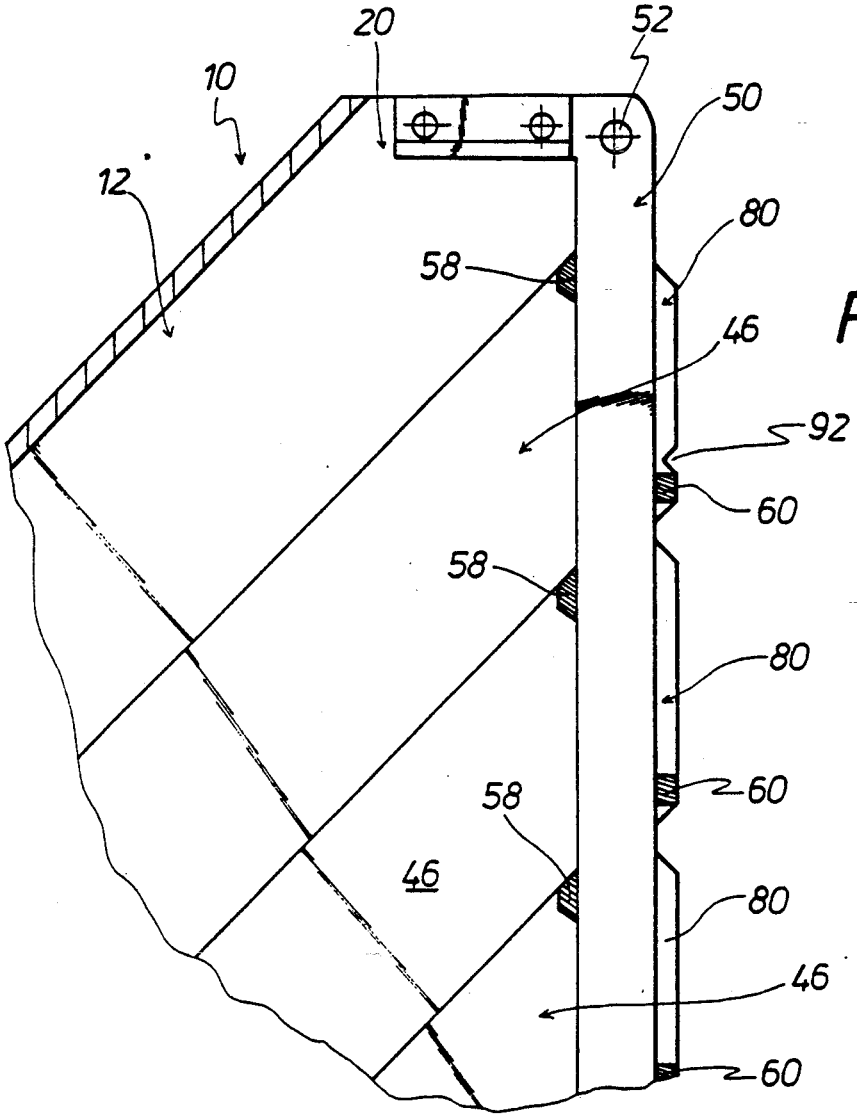
FIG. 4 illustrates a fragmentary portion of the lamella wing in the extended flying position.

The lamella or sheet metal element 46 which is adjacent the nose spar 12 is formed at its second end section 80 with a contact or positioning portion 92 which, in particular, is clearly ascertainable in FIG. 4 of the drawings. By means of the contact portion 92, the lamella element 46 which is adjacent the nose spar 12 lies against the extension part 86 of the latching device 82 in the retracted initial position of the lamella wing 10, as illustrated in FIG. 1. When, upon an activation of the power element (not shown) which is operatively connected with the base spar (not shown), the base spar and resultingly the lamella elements 46 which are pivotably connected with the base spar are displaced towards the right in the direction of the arrow 94, then the extension part 86 of the latching device 82 is concurrently displaced towards the right by respectively the same distance, inasmuch as on the extension part 86, as has already been mentioned, the lamella element 46 which is located adjacent to the nose spar 12 contacts thereagainst with its contacting portion 92. During this displacement of the extension part 86 of the latching device 82 through a distance s, which is indicated between FIGS. 1 and 2, the connecting portion 88 between the extension part 86 and the hook elements 84 is deformed, such that the hook elements 84 carry out a pivoting movement in the counter-clockwise direction about the fixed axis 90, and thereby release the connecting axis 52, to which the stabilizing element 50 is hingedly connected on the nose spar 12, as can be ascertained from FIG. 2. After this release of the connecting axis 52, it is possible due to the sliding movement carried out in the direction of the arrow 96, as shown in FIG. 2, (by means of the power element, not shown) that the nose spar 12, and with the nose spar 12 the lamella elements 46 together with the stabilizing element 50, are swung away from the airborne body 48 into the extended operative, in essence, flying position, as shown in fragmentary representation in FIG. 4.

In FIGS. 1 through 4 the same details are each identified by the same reference numerals, so that it becomes unnecessary in connection with FIGS. 2 through 4, to again having to describe in detail all components mentioned in connection with FIG. 1.

What is claimed is:

1. In a lamella wing which is extendable from an airborne body, and is of the type including a base spar actuatable by a power element, a nose spar having a first end section pivotably supported about a bearing axis located on said airborne body, at least one lamella element which extends at least approximately in parallel with the nose spar in every angular position thereof, said one lamella element having one end section thereof pivotably supported on said bare spar through an axis for lamella elements, a stabilizing element which is supported on a second end section of the nose spar for pivoting movement about a connecting axis distant from said first end section, said stabilizing element extending through contacting elements at a distance from the associated axis for lamella elements and a latching device for maintaining the nose spar and said at least one lamella element in the retracted initial position of the lamella wing and for releasing the nose spar and said at least one lamella element subsequent to an activation of the power element, the improvement comprising in that said latching device incorporates at least one hook element which is pivotable about a fixed axis located on said airborne body for movement between a restraining position and a releasing position, said at least one hook element in the retracted initially latched position of the lamella wing being hooked on the connecting axis between the nose spar and the stabilizing element, in an unlatched and retracted position of said nose spar and said one lamella said hook element being disengaged from said connecting axis, and the lamella element adjacent the nose spar having a contacting portion on the second end section thereof for engaging said latching device to maintain said wing in an extended and latched condition subsequent to the extending of said wing from said airborne body.

2. A lamella wing as claimed in claim 1, wherein the latching device possesses two mutually spaced of said hook elements oriented at least approximately in parallel with each other and including an extension part, a deformable connecting segment being arranged intermediate the extension part and said hook elements, and the lamella element adjacent the nose spar in the retracted initial latched position of the lamella wing lying with a contacting portion thereof against the extension part of the latching device.

* * * * *

UNITED STATES PATENT AND TRADEMARK OFFICE

CERTIFICATE OF CORRECTION

PATENT NO. : 5,137,229

DATED : August 11, 1992

INVENTOR(S) : Manfred Kraus

It is certified that error appears in the above-identified patent and that said Letters Patent is hereby corrected as shown below:

Column 5, line 58, Claim 1: "bare" should read as --base--

Column 4, line 63, Claim 1: "elements at a distance" should read as --elements at a second end section of said at least one lamella element at a distance--

Signed and Sealed this

Twenty-eighth Day of September, 1993

*Attest:*

*Attesting Officer*

BRUCE LEHMAN

*Commissioner of Patents and Trademarks*